US005230645A

United States Patent [19]

Cheng

[11] Patent Number: 5,230,645

[45] Date of Patent: Jul. 27, 1993

[54] MULTIPURPOSE LIFE PRESERVER

[76] Inventor: Chun-Ming Cheng, 2F, 55, Pin Teng Street, Hsin Dian Taipei, Taiwan

[21] Appl. No.: 876,490

[22] Filed: Apr. 30, 1992

[51] Int. Cl.[5] ..... B63C 9/20

[52] U.S. Cl. ..... 441/123; 2/69.5; 441/113

[58] Field of Search ..... 441/80, 81, 102, 103, 441/106, 108, 111-116, 119-123

[56] References Cited

U.S. PATENT DOCUMENTS

| | | | |
|---|---|---|---|
| 1,502,543 | 7/1924 | Boddy | 441/115 |
| 2,338,535 | 1/1944 | Pfleumer | 441/113 |
| 3,225,369 | 12/1965 | Kerwick | 441/115 |
| 3,616,475 | 11/1971 | Lewis | 441/113 |
| 3,727,249 | 4/1973 | Bonthezius | 441/123 |
| 4,662,856 | 5/1987 | Bostic | 441/123 |

*Primary Examiner*—Joseph F. Peters, Jr.

*Assistant Examiner*—Clifford T. Bartz

*Attorney, Agent, or Firm*—Pro-Techtor International

[57] ABSTRACT

A life preserver formed of a flat, rectangular sheet body made of a cellular low density polyethylene in thickness within 0.5-1.5 m/m, the sheet body including a male fastener and a female fastener aligned on the longitudinal center line of the bottom edge thereof at two opposite ends, a zip fastener on the longitudinal center line of the bottom thereof at the center, self-sticking fastening elements longitudinally symmetrically aligned along two opposite longer sides of teh bottom edge thereof, and male and female snap fasteners alternatively arranged along the border of the top edgte thereof. The zip fastener is unfastened for inserting the user's head. With the fastening elements thereof respectively connected together, the life preserver is put on the user to serve as a life jacket.

2 Claims, 4 Drawing Sheets

MULTIPURPOSE LIFE PRESERVER

BACKGROUND OF THE INVENTION

The present invention relates to life preservers, and more particularly, the present invention relates to a life preserver which is made from a cellular low density polyethylene, and which can be used as a life jacket to float the user on water, or a covering for keeping the body warm.

A life preserver according to the prior art, is a buoyant device for saving a person from drowning by keeping his body afloat, as a ring or sleeveless jacket of canvas-covered cork or kapok. This structure of life preserver is simmply used to float a person on water, and can not be used for other purposes.

SUMMARY OF THE INVETNION

One object of the present invention is to provide a life preserver which is made from a cellular low density polyethylene that floats a person on water. Another object of thepresent invention is to provide a life preserver which can be conveniently fastened on the body to serve as a life jacket. Still another object of the present invention is to provide a life preserver which is so arranged that two life preservers of the same structure can be conveniently attached together, forming a sleeping bag for sleeping.

DETAILED DESCRIPTION OF THE PREFERRED EMBODIMENT

Figures 1, 1A:
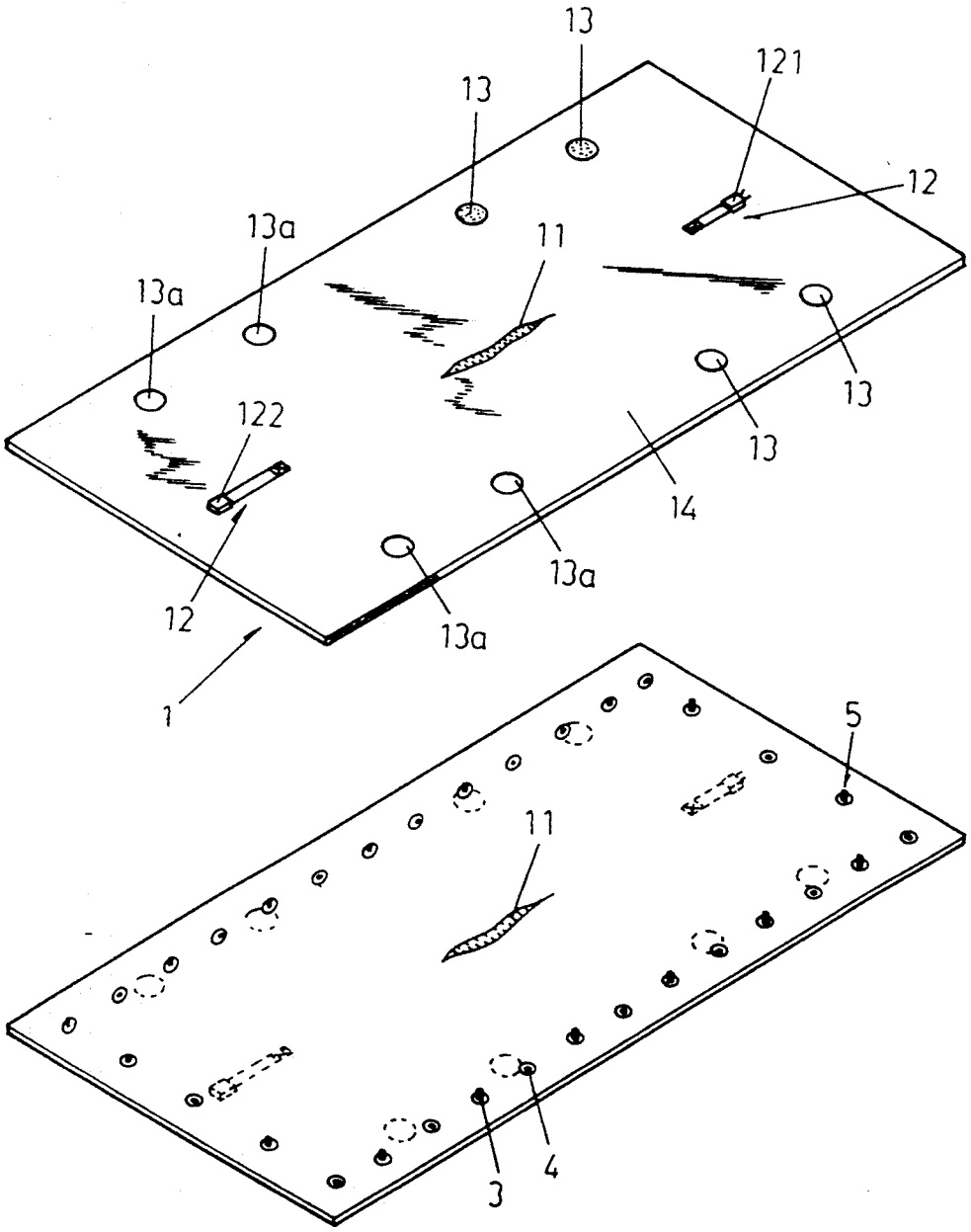
FIG. 1 shows the bottom edge and top edge views of the preferred embodiment of the multipurpose life preserver of the present invention when extended out.
FIG. 1A is a cross section of the multipurpose life preserver of FIG. 1 showing the foamy material of cellular LDPE.

Referring to FIGS. 1 and 1A, a multipurpose life preserver is generally comprised of a flexible flat body 1. The flexible flat body 1 is preferably made from a cellular low density polyethylene (cellular LDPE) in thickness 0.5–1.5 m/m. This celluar structure has a density about 2–8 lb/ft$^3$ (0.03–0.08 g/cm$^3$). According to test, 300 g of cellular LDPE can float a load of 130 kgs on water.

Referring to FIG. 1 again, the bottom edge 14 of the flexible flat body 1 comprises a male fastener 121 and a female fastener 122 aligned on the longitudinal center line thereof at two opposite ends, a zip fastener 11 on the longitudinal center line thereof at the center between the male and female fasteners 121 and 122, and self-sticking fastening elements 13 and **13*a* longitudinally symmetrically aligned along two opposite longer sides thereof, wherein the male and female fasteners 121 and 122** form into a fastening device.

Figure 2:
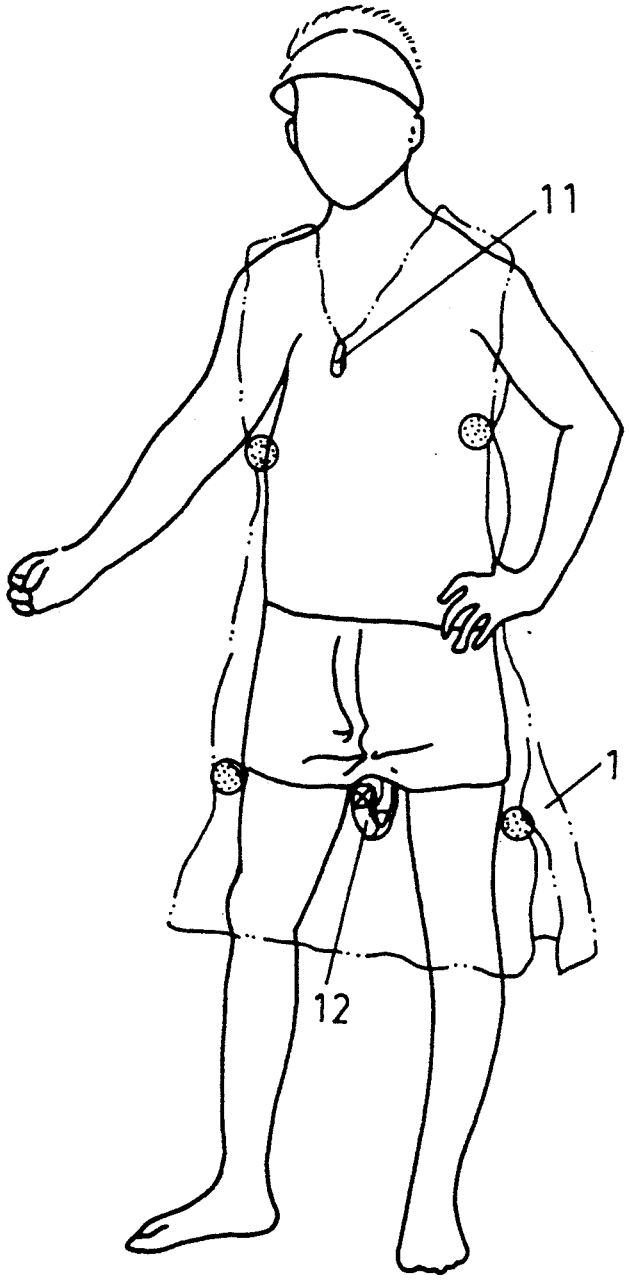
FIG. 2 is a schematic drawing showing that the multipurpose life preserver has been folded and fastened on a person serving as a life jacket.
Figure 3:
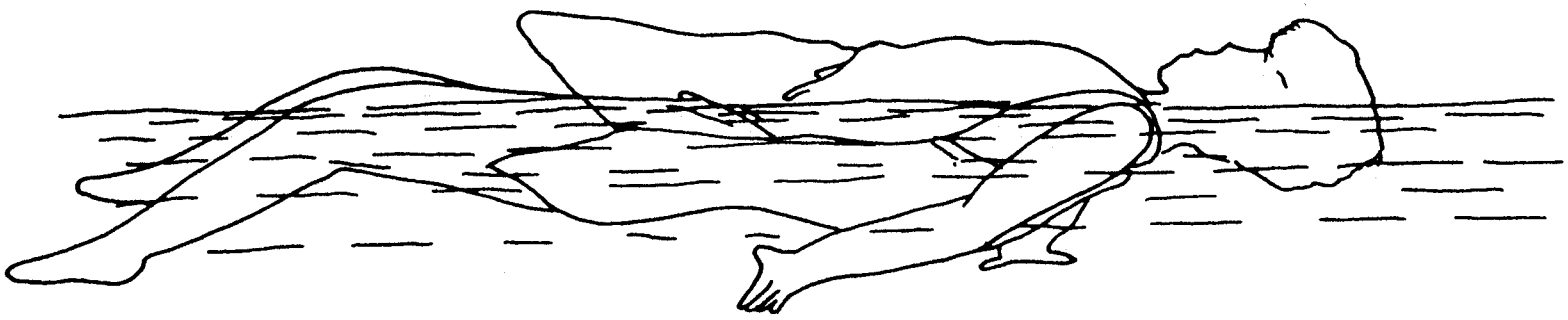
FIG. 3 illustrates the use of the present invention to float a person on water.
Figure 4:
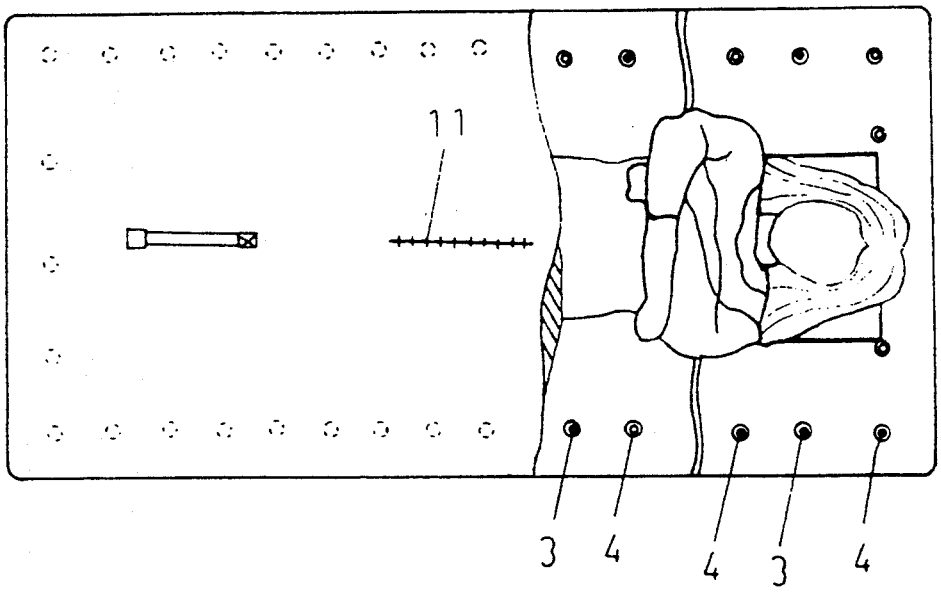
FIG. 4 illustrates another arrangement by two pieces of the present invention to serve as a sleeping bag.

Referring to FIGS. 2 and 3, therein illustrated is an application example of the present invention serving as a life jacket. The zip fastener 11 is unfastened to provide an opening for the head passing through. When the flexible flat body 1 has been put on a person, the self-sticking elements 13 and **13*a* are respectively connected together, and the fastening device 12 is fastened up between the legs. As illustrated in FIG. 3, the cellular structure of the flat body 1** floats the user on water.

Referring to FIG. 1 again, the top edge 5 of the flexible flat body 1 comprises a plurality of male and female snap fasteners 3 and 4 alternatively arranged along the border thereof. By means of the male and female snap fasteners 3 and 4, two flexible flat bodies 1 of the same structure are attached together forming a sleeping bag.

What is claimed is:

1. A multipurpose life preserver comprised of a flat, rectangular sheet body made of cellular low density polyethylene between 0.5 and 1.5 mm in thickness, wherein said sheet body is folded to a length suitable for a life preserver, a bottom surface of the sheet body including at a longitudinal midpoint of a first end of the sheet body a first element of a fastener, and including at a longitudinal midpoint of a second end of the sheet body a second element of the fastener so that the two ends fo the sheet body may be fastened between the legs of a user, the fastener being adjustable in length so that various users' body sizes are accommodated; and further including a central opening in the sheet body to accommodate the user's head; and further including multiple self-adhering fastening elements on the periphery of the sheet body such that the preserver may be securely fastened about the user's body; and wherein the sheet body includes means to completely close the central opening, whereby two of the devices coupled together via the self-adhering elements form a sleeping bag.

2. The device of claim 1 wherein:

the means to completely close the central opening is a zipper.

* * * * *